US008444381B2

(12) United States Patent
Seely

(10) Patent No.: US 8,444,381 B2
(45) Date of Patent: May 21, 2013

(54) GAS TURBINE BUCKET WITH SERPENTINE COOLED PLATFORM AND RELATED METHOD

(75) Inventor: Melissa Ann Seely, Taylors, SC (US)

(73) Assignee: General Electric Company, Schenectady, NY (US)

( * ) Notice: Subject to any disclaimer, the term of this patent is extended or adjusted under 35 U.S.C. 154(b) by 669 days.

(21) Appl. No.: 12/732,610

(22) Filed: Mar. 26, 2010

(65) Prior Publication Data

US 2011/0236206 A1 Sep. 29, 2011

(51) Int. Cl.
*F01D 5/08* (2006.01)
*F01D 5/18* (2006.01)

(52) U.S. Cl.
USPC ..... 416/1; 416/95; 416/96 R; 416/97 R; 416/193 A; 415/1; 415/115

(58) Field of Classification Search
USPC ..... 415/1, 115; 416/1, 95, 96 A, 96 R, 416/97 R, 97 A, 193 A
See application file for complete search history.

(56) References Cited

U.S. PATENT DOCUMENTS

| | | | | |
|---|---|---|---|---|
| 3,066,910 | A * | 12/1962 | Bluck | 416/92 |
| 4,312,625 | A * | 1/1982 | Pinaire | 416/96 R |
| 5,639,216 | A | 6/1997 | McLaurin et al. | |
| 5,813,835 | A * | 9/1998 | Corsmeier et al. | 416/97 R |
| 5,915,923 | A * | 6/1999 | Tomita et al. | 416/96 R |
| 5,993,155 | A * | 11/1999 | Endres et al. | 416/96 R |
| 6,017,189 | A * | 1/2000 | Judet et al. | 416/97 R |
| 6,190,130 | B1 | 2/2001 | Fukue et al. | |
| 6,431,833 | B2 | 8/2002 | Jones | |
| 7,147,439 | B2 | 12/2006 | Jacala et al. | |
| 7,309,212 | B2 * | 12/2007 | Itzel et al. | 416/193 A |
| 7,416,391 | B2 * | 8/2008 | Veltre et al. | 416/97 R |
| 7,553,131 | B2 * | 6/2009 | Cunha et al. | 416/92 |
| 7,819,629 | B2 * | 10/2010 | Liang | 416/97 R |

* cited by examiner

*Primary Examiner* — Igor Kershteyn
(74) *Attorney, Agent, or Firm* — Nixon & Vanderhye, P.C.

(57) ABSTRACT

A cooling circuit for a turbine bucket having a shank, a platform and an airfoil. The cooling circuit includes a first cooling passage extending from an inlet located at a radially inward end of the shank and adapted to communicate with a turbine wheel-space, the first cooling passage, in use, supplying cooling air to a serpentine cooling circuit extending within and across at least one region of the platform. The serpentine cooling circuit connects with a separate internal cooling circuit in the airfoil, such that the cooling air used to cool the platform is re-used in the airfoil cooling circuit.

18 Claims, 5 Drawing Sheets

GAS TURBINE BUCKET WITH SERPENTINE COOLED PLATFORM AND RELATED METHOD

BACKGROUND OF THE INVENTION

The present invention relates generally to gas turbine buckets or blades and particularly relates to cooling a so-called platform portion interposed between the bucket airfoil and the bucket shank.

Over the years, gas turbines have trended toward increased inlet firing temperatures to improve output and engine efficiencies. As hot gas path temperatures have increased, however, bucket platforms have increasingly exhibited distress including oxidation, creep and low-cycle fatigue cracking, spallation and in some cases, platform liberation. With the advent of closed circuit steam cooling in, for example, the buckets and nozzles in the first two stages of industrial gas turbines, inlet profiles have become such that the bucket platforms are exposed to temperatures close to peak inlet temperatures for the blade row. The problem is particularly acute at the leading edge fillet where the airfoil joins the platform at the forward portion of the pressure side of the airfoil.

Accordingly, it would be beneficial if more effective cooling arrangements can be designed to cool the platform areas of buckets used particularly in the first and second stages of the turbine.

SUMMARY OF THE INVENTION

In a first exemplary but nonlimiting embodiment, the present invention relates to a cooling circuit for a turbine bucket having a shank portion, a platform portion and an airfoil portion, the cooling circuit comprising a first cooling passage extending from a cooling air inlet located at a radially inward end of said shank portion so as to communicate with a turbine wheelspace when in use, said first cooling passage connecting to a second cooling passage extending within and across at least one region of said platform, said second cooling passage connecting with a third cooling passage extending radially outwardly in said airfoil portion, said third cooling passage terminating at one or more cooling air outlets located at a radially outward end of said airfoil portion.

In another exemplary but nonlimiting embodiment, the invention relates to a cooling circuit for a turbine bucket having a shank, a platform and an airfoil, the cooling circuit comprising: a first cooling passage extending from an inlet located at a radially inward end of the shank and adapted to communicate with a turbine wheel-space, the first cooling passage, in use, supplying cooling air to a serpentine cooling circuit extending within and across at least one region of the platform, said serpentine cooling circuit connecting with a separate internal cooling circuit passage proximate a trailing edge of the airfoil, such that the cooling air used to cool the platform is re-used in the airfoil cooling circuit; wherein the platform includes a first region on a pressure side of the airfoil portion and a second region on a suction side of the airfoil portion, the at least one region comprising the first region on the pressure side of the airfoil.

In still another exemplary but nonlimiting embodiment, the invention provides a method of cooling a gas turbine bucket platform comprising: extracting compressor cooling air from a wheel space area between blade wheels mounted on a turbine rotor; feeding extracted compressor cooling air from a radially oriented passage along a leading edge of a shank portion of the bucket to a serpentine cooling passage formed in the platform; dumping the extracted compressor cooling air into an internal cooling circuit in the bucket airfoil; and exhausting the extracted compressor cooling air along a trailing edge of the bucket airfoil.

The invention will now be described in detail in connection with the drawings identified below.

DETAILED DESCRIPTION OF THE INVENTION

In general terms, the present invention relates to a turbine bucket platform cooling arrangement where a portion of the compressor-extracted air that is used to cool the wheel space areas between the rotor wheels is fed to the bucket platform through a passage on the lower outlet side of the bucket shank portion. This passage will feed the extracted air radially outwardly to the platform where it will turn substantially 90 degrees and follow a serpentine passage along and around the "inner portion" of the platform, i.e., that portion on the pressure side of the bucket airfoil. The extracted cooling air will then dump into one of the radially-extending internal core cooling passages of the bucket airfoil to be used for airfoil cooling.

Figure 1:
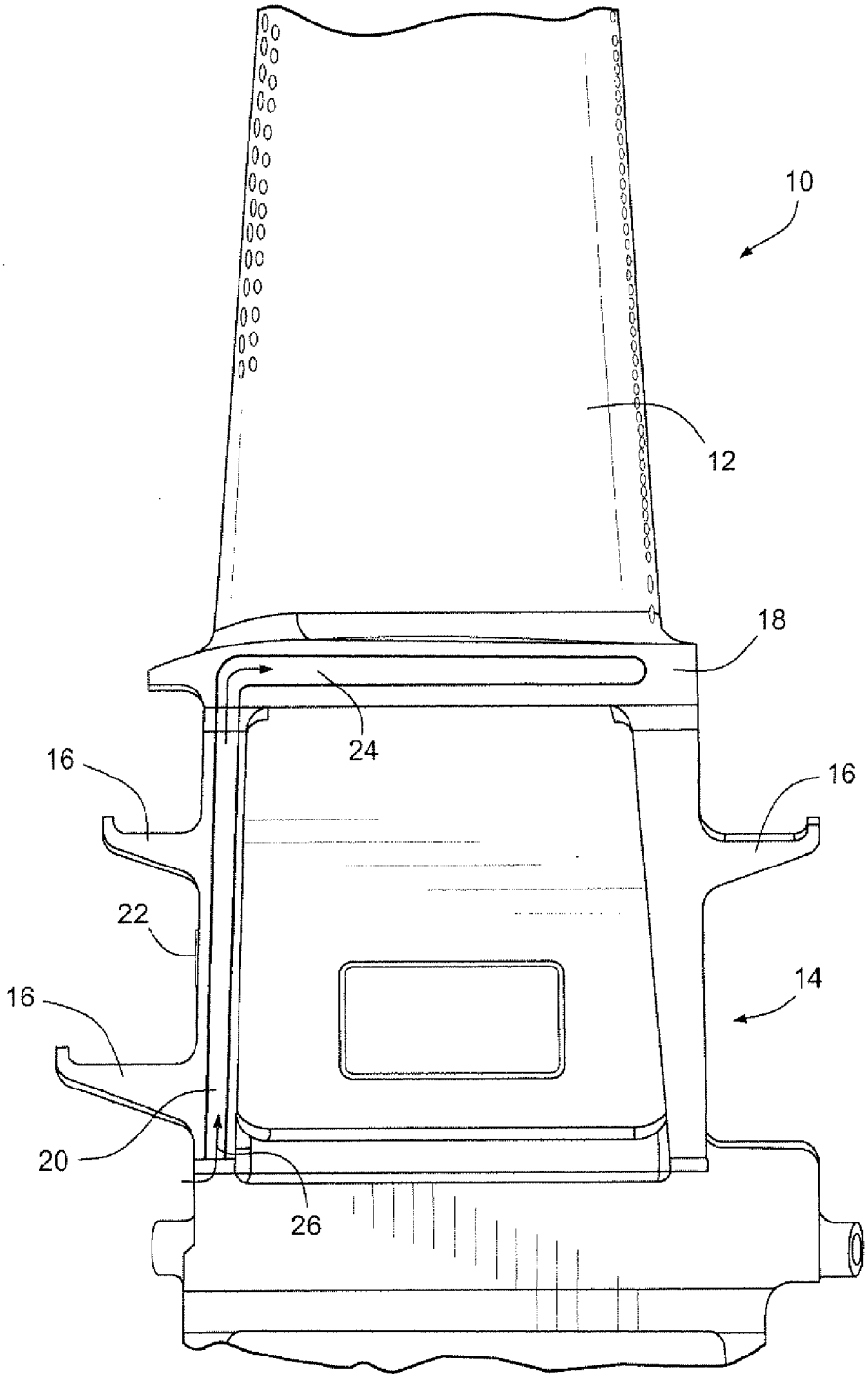
FIG. 1 is a side elevation, partly in section, of a turbine bucket in accordance with a first exemplary but nonlimiting embodiment of the invention.

More specifically, and with reference to FIG. 1, a turbine bucket 10 includes an airfoil 12 and a shank 14, typically formed with so-called angel-wing seals 16. A relatively flat platform 18 is located radially between the airfoil 12 and the shank 14. In accordance with an exemplary but nonlimiting embodiment, a cooling air inlet passage 20 is formed (e.g., drilled or cast) in a forward or leading face 22 of the bucket shank 14. The inlet passage 20 extends radially outwardly to the platform 18 where it turns substantially 90 degrees into a platform cooling circuit generally indicated at 24. The inlet 26 to the radial passage 20 is radially aligned with the passage 20.

Figure 2:
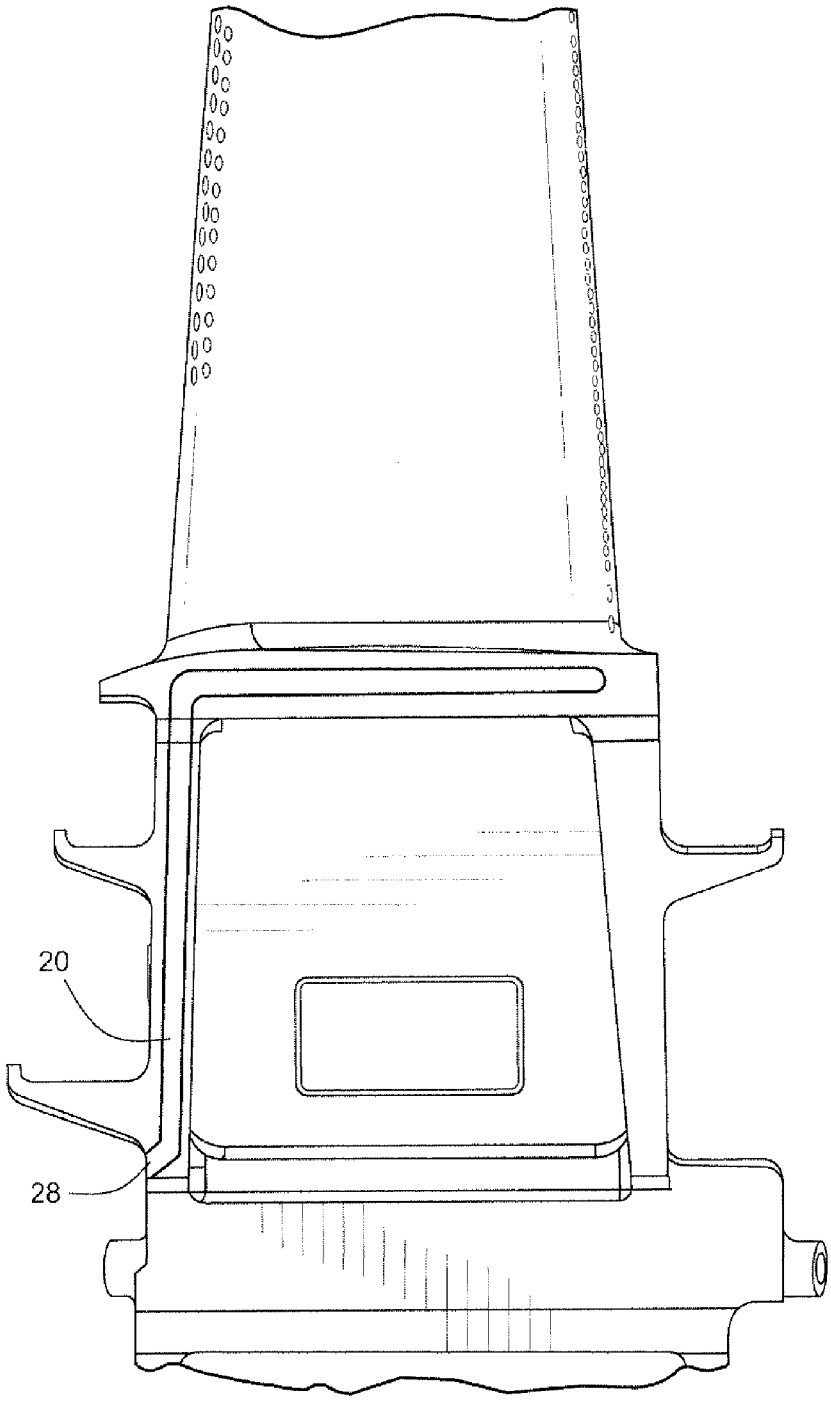
FIG. 2 is a side elevation, partly in section, showing an alternative cooling air inlet configuration.

FIG. 2 illustrates an alternative arrangement by where the inlet 28 to the passage 20 is formed at an acute angle to the passage, illustrating an alternative manufacturing expedient. The construction is otherwise substantially identical to that shown in FIG. 1, and either inlet arrangement may be employed with each of the serpentine cooling circuits described below.

Figure 3:
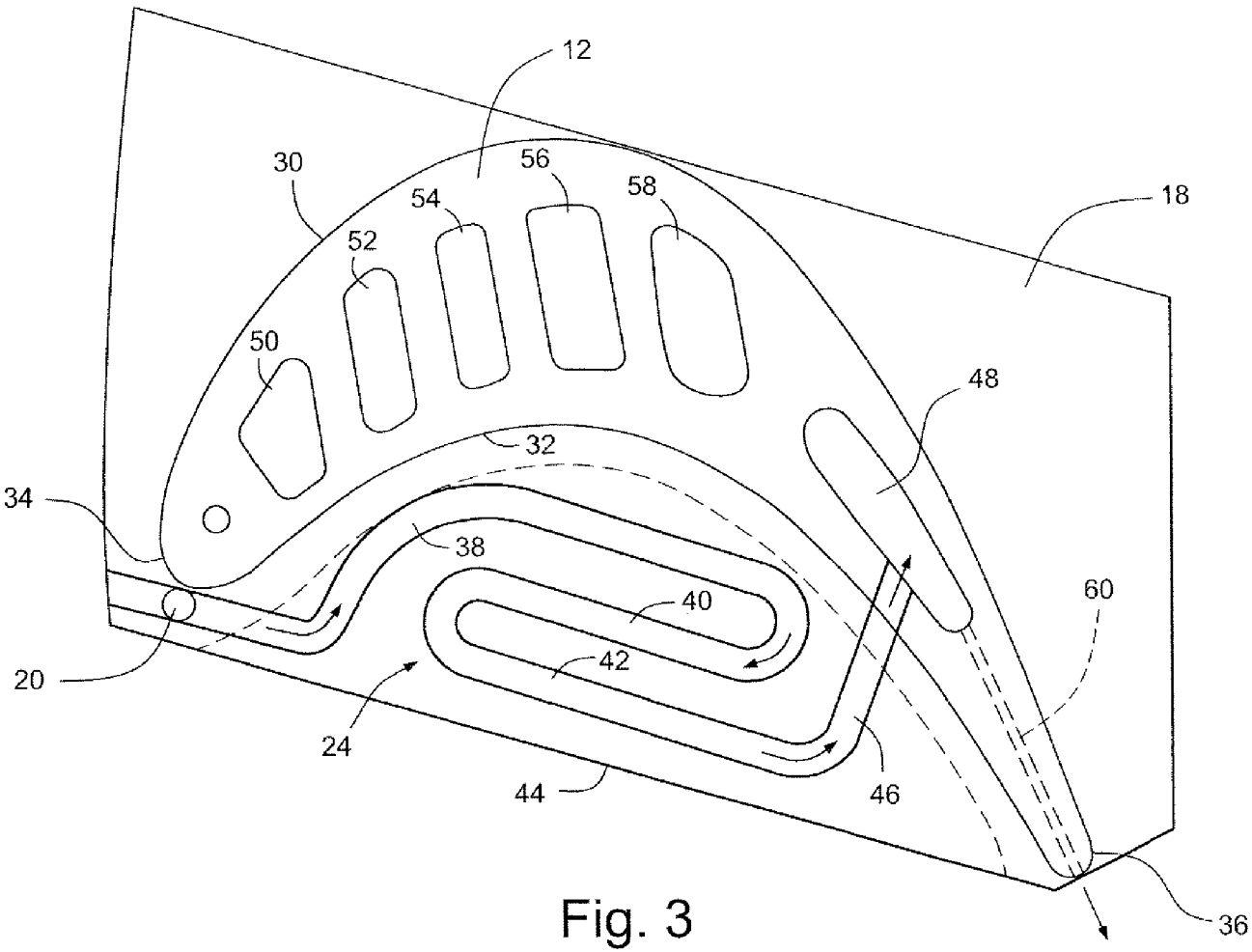
FIG. 3 is a top plan view in schematic form showing a serpentine platform cooling circuit in accordance with the first exemplary embodiment of the invention.

Turning now to FIG. 3, a serpentine cooling circuit 24 for cooling the platform 18 is shown in accordance with one exemplary but nonlimiting embodiment. Note initially that the bucket airfoil 12 has a suction side 30, a pressure side 32, a leading edge 34 and a trailing edge 36. The inlet passage 20 is located along the leading edge of the shank 14, adjacent the leading edge 34 of the airfoil. The serpentine cooling circuit 24 is formed within the platform 18 (by e.g., casting) so as to provide a first cooling passage section 38 that serves to cool an area proximate the pressure side 32 of the airfoil and including the fillet area where the airfoil 12 is joined to the platform 18. The cooling flow then reverses through a cooling passage section 40 in a middle region of the platform, and then reverses again in a cooling passage section 42 that runs proximate an edge 44 of the platform. The circuit then turns substantially 90° in a cooling passage section 46 and then dumps the cooling air into a radially extending internal airfoil cooling passage 48 closest to the airfoil trailing edge 36. The radial cooling passage 48 is part of an internal serpentine cooling circuit in the airfoil 12 which includes a number of radial connected passages 50, 52, 54, 56, 58 and 48. Typically, the coolant flows through the circuit in a direction from the leading edge to the trailing edge, exiting the airfoil through plural passages 60 extending from the radial passage 48 to the trailing edge 36.

Figure 4:
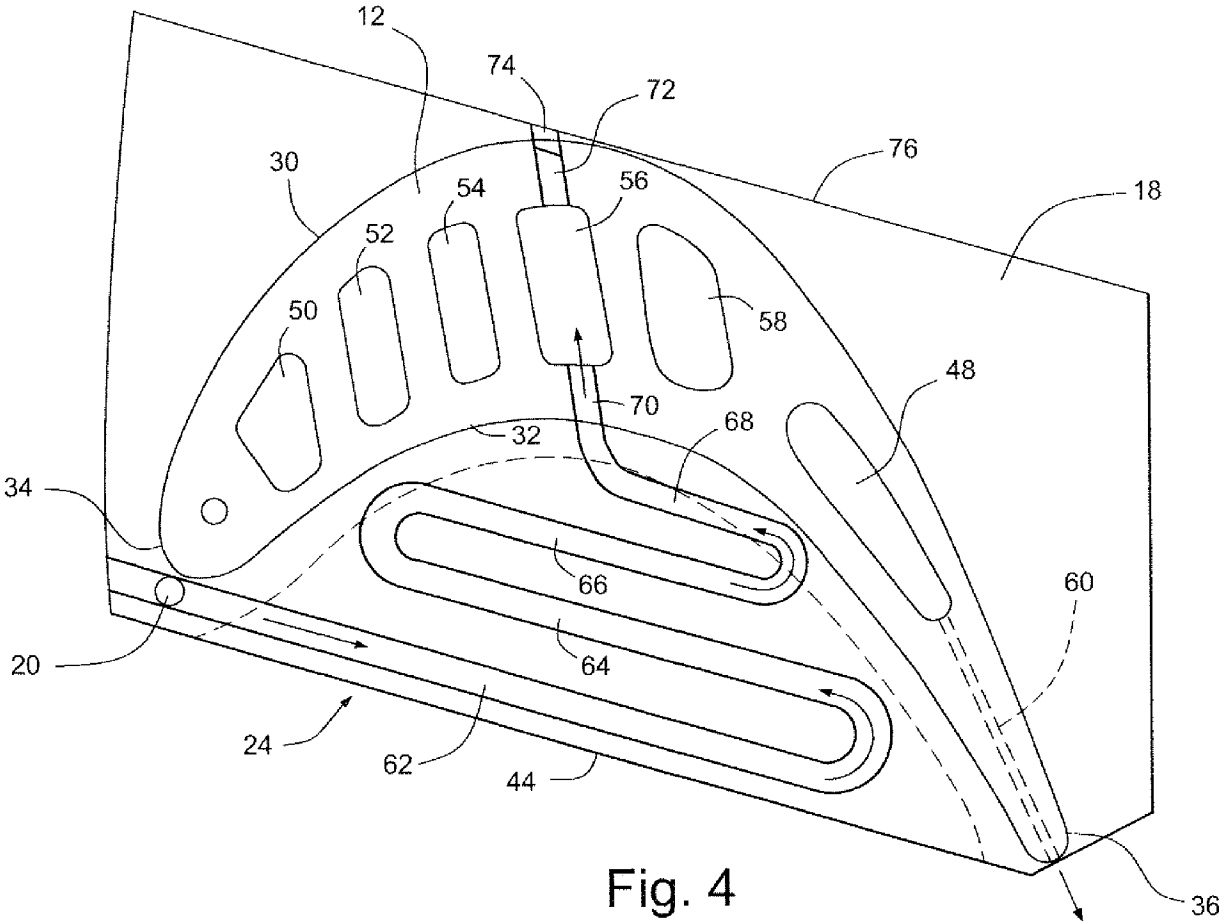
FIG. 4 is a top plan view in schematic form illustrating an alternative serpentine cooling circuit in accordance with another exemplary but nonlimiting embodiment of the invention.

FIG. 4 shows an alternative serpentine cooling circuit 124 for cooling the platform 18. Here, the inlet passage 20 remains adjacent the leading edge 34 of the airfoil 12. A first cooling passage section 62 of the cooling circuit 124 runs along the edge 44 of the platform 18 and then reverses in a cooling passage section 64 along a middle region of the platform before reversing again in a cooling passage section 66 closer to the suction side 32 of the bucket airfoil. The cooling circuit then reverses through a cooling passage section 68 and turns into the middle portion of the airfoil via cooling passage section where it dumps into the radially-extending internal airfoil cooling passage 56. The internal airfoil cooling circuit remains as described above in connection with FIG. 3. To facilitate the manufacturing process, the cooling passage section 70 is more easily formed by initiating a drilling operation from the opposite edge 76 of the platform 18, forming an extending cooling passage section 72. To maintain the integrity of the cooling circuit, the extended cooling passage section 72 is plugged at 74. The otherwise relatively short cooling passage section 72 may provide some additional, albeit minor, cooling to the platform.

Figure 5:
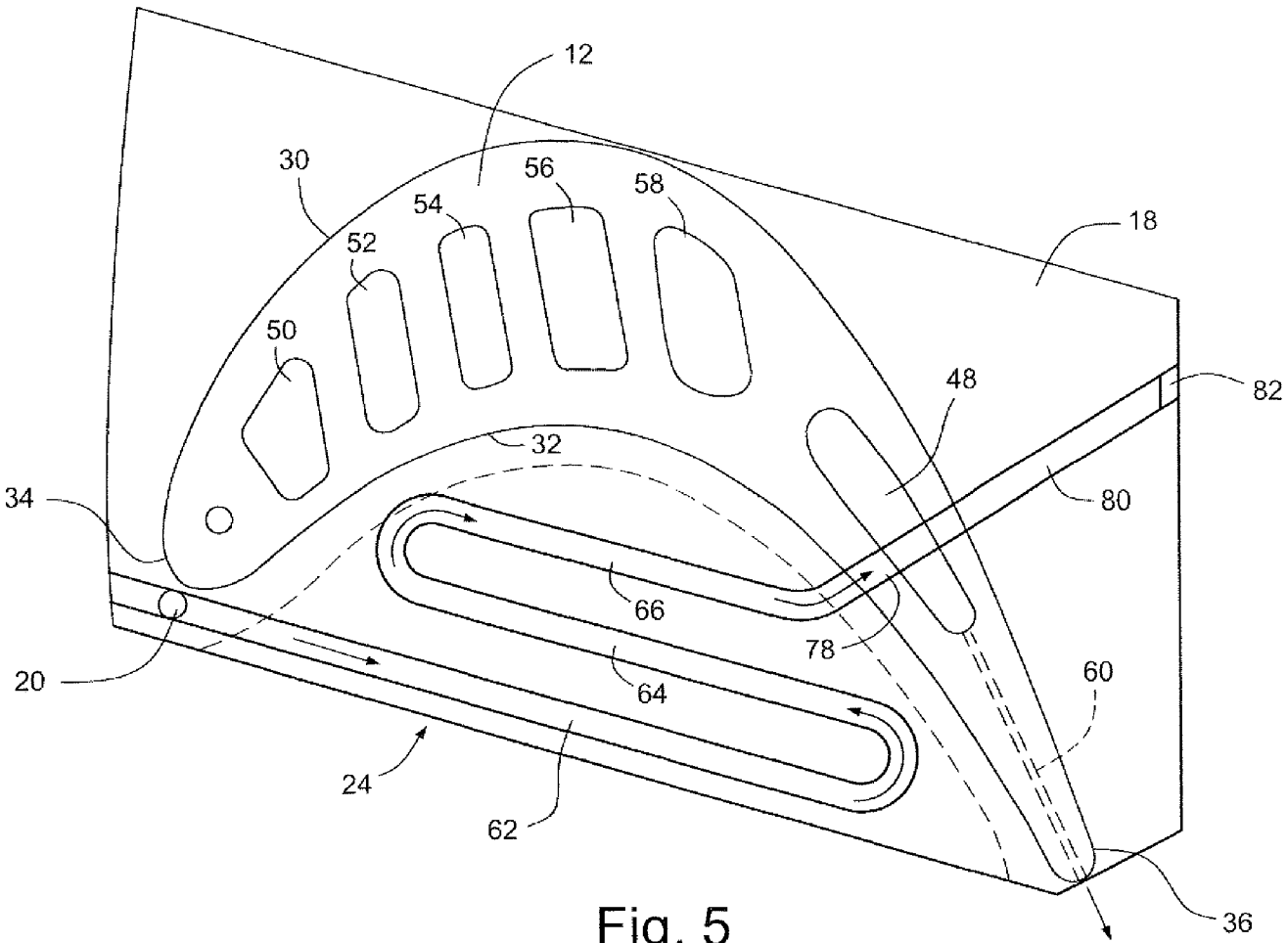
FIG. 5 is a top plan view in schematic form illustrating a serpentine cooling circuit in accordance with another exemplary but nonlimiting embodiment of the invention.

FIG. 5 illustrates a third exemplary but nonlimiting embodiment of a suitable serpentine cooling circuit. This cooling circuit 224 contains the same cooling passage sections 62, 64 and 66 as shown in FIG. 4. In this embodiment, however, the cooling circuit 224 again dumps into the trailing edge airfoil cavity 48 as in the first described embodiment, via a cooling passage section 78. The manufacture of cooling passage section 78 is facilitated by drilling an extended passage 80 through the platform, on the suction side 30 of the airfoil 12, plugged at 82, similar to the manner in which passage section 72 is plugged at 74 in FIG. 4. Because of the length of the extended passage section 80, some meaningful cooling of the suction side of the platform 18 is provided.

In each of the above-described embodiments, the serpentine cooling circuit 24, 124 and 224 formed in the bucket platform 18 is fed from compressor-extraction air taken in at the lower, leading side of the bucket shank. The cooling air is then routed along the serpentine platform cooling circuit before being dumped into the internal airfoil cooling circuit where the platform cooling air is re-used for cooling the airfoil. The cooling air is then exhausted through the trailing edge of the bucket along with the airfoil cooling circuit air. This arrangement effectively film cools both the forward face of the shank and the platform, while providing additional cooling air to the airfoil. In addition, pulling compressor extraction air directly into the bucket provides air at higher pressure to the problematic platform area which helps reduce the platform temperature and prolong the life of the bucket. This, in turn, results in reduced repair costs over the service life of the bucket.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

I claim:

1. A cooling circuit for a turbine bucket having a shank, a platform and an airfoil, the cooling circuit comprising:

a first cooling passage extending radially outwardly along a leading face of the shank from an inlet located at a radially inward end of said shank adapted to communicate with a turbine wheel-space, said first cooling passage, in use, supplying cooling air only to a single serpentine cooling circuit extending within and across a region of said platform on a pressure side of the airfoil, said serpentine cooling circuit connecting with a separate internal cooling circuit in said airfoil with exit passages along a trailing edge of said airfoil, such that the cooling air used to cool the platform is re-used in the airfoil cooling circuit.

2. The cooling circuit of claim 1 wherein said inlet is located proximate a leading edge of said airfoil.

3. The cooling circuit of claim 1 wherein said serpentine cooling circuit includes at least three substantially parallel cooling passage sections.

4. The cooling circuit of claim 1 wherein said serpentine cooling circuit connects to a radial passage in said internal cooling circuit in said airfoil located proximate a trailing edge of said airfoil.

5. The cooling circuit of claim 1 wherein said serpentine cooling circuit connects to a radial passage in said internal cooling circuit in said airfoil located substantially midway between leading and trailing edges of said airfoil.

6. The cooling circuit of claim 1 wherein said serpentine cooling circuit is connected to said internal airfoil cooling circuit by an extended cooling passage section that extends beyond the airfoil and along a suction side of said airfoil to a peripheral edge of the platform.

7. The cooling circuit of claim 6 wherein said extended cooling passage is plugged at said peripheral edge of the platform.

8. The cooling circuit of claim 5 wherein said serpentine cooling circuit is connected to said internal airfoil cooling circuit by an extended cooling passage section that extends beyond the airfoil and along a suction side of said airfoil to a peripheral edge of the platform.

9. The cooling circuit of claim 8 wherein said extended cooling passage is plugged at said peripheral edge of the platform.

10. A cooling circuit for a turbine bucket having a shank, a platform and an airfoil, the cooling circuit comprising:

a first cooling passage extending radially outwardly along a leading face of the shank from an inlet located at a radially inward end of the shank adapted to communicate with a turbine wheel-space, the first cooling passage, in use, supplying cooling air only to a single serpentine cooling circuit extending within and across the platform in a region on a pressure side of said airfoil, said serpentine cooling circuit connecting with a separate internal cooling circuit passage proximate a trailing edge of the airfoil, such that the cooling air used to cool the platform is re-used in the airfoil cooling circuit the cooling air exiting along the trailing edge of the airfoil.

11. The cooling circuit of claim 10 wherein said serpentine cooling circuit includes at least three substantially parallel cooling passage sections.

12. The cooling circuit of claim 10 wherein said serpentine cooling circuit is connected to said internal airfoil cooling circuit by an extended cooling passage section that extends beyond the airfoil and along the suction side of the platform to a peripheral edge of the platform.

13. The cooling circuit of claim 12 wherein said extended cooling passage is plugged at said peripheral edge of the platform.

14. A method of cooling a gas turbine bucket platform comprising:

(a) extracting compressor cooling air from a wheel space area between blade wheels mounted on a turbine rotor;

(b) feeding extracted compressor cooling air from a radially oriented passage along a leading edge of a shank portion of the bucket to a single serpentine cooling passage formed in the platform;

(c) dumping the extracted compressor cooling air into an internal cooling circuit in the bucket airfoil; and (d) exhausting the extracted compressor cooling air along a trailing edge of the bucket airfoil.

15. The method of claim 14 wherein said serpentine cooling circuit connects to a radial passage in said internal cooling circuit in said airfoil located proximate a trailing edge of said airfoil.

16. The method of claim 14 wherein said serpentine cooling circuit connects to a radial passage in said internal cooling circuit in said airfoil located substantially midway between leading and trailing edges of said airfoil.

17. The method of claim 15 wherein said serpentine cooling circuit is connected to said internal airfoil cooling circuit by an extended cooling passage section that extends beyond the airfoil and along the suction side of the platform to a peripheral edge of the platform.

18. The method of claim 16 wherein said serpentine cooling circuit is connected to said internal airfoil cooling circuit by an extended cooling passage section that extends beyond the airfoil and along the suction side of the platform to a peripheral edge of the platform.

* * * * *

UNITED STATES PATENT AND TRADEMARK OFFICE

CERTIFICATE OF CORRECTION

PATENT NO. : 8,444,381 B2
APPLICATION NO. : 12/732610
DATED : May 21, 2013
INVENTOR(S) : Melissa Ann Seely It is certified that error appears in the above-identified patent and that said Letters Patent is hereby corrected as shown below:

In the Specification

At column 3, line 27, insert --70-- between "cooling passage section" and "where"

Signed and Sealed this
Sixteenth Day of July, 2013

Teresa Stanek Rea
*Acting Director of the United States Patent and Trademark Office*